US005540428A

United States Patent [19]

Joseph

[11] Patent Number: 5,540,428

[45] Date of Patent: Jul. 30, 1996

[54] BASKETBALL RETRIEVAL AND RETURN APPARATUS

[76] Inventor: John G. Joseph, 3305 C.H. 47, Upper Sandusky, Ohio 43351

[21] Appl. No.: 393,351

[22] Filed: Feb. 23, 1995

[51] Int. Cl.[6] ..... A63B 69/00

[52] U.S. Cl. ..... 273/1.5 A

[58] Field of Search ..... 273/1.5 A, 396, 273/397

[56] References Cited

U.S. PATENT DOCUMENTS

| | | | |
|---|---|---|---|
| 4,786,731 | 11/1988 | Postol | 273/1.5 A |
| 4,936,577 | 6/1990 | Kington et al. | 273/1.5 A |
| 5,333,853 | 8/1994 | Hektor | 273/1.5 A |
| 5,393,049 | 2/1995 | Nelson | 273/1.5 A |

*Primary Examiner*—Paul E. Shapiro
*Attorney, Agent, or Firm*—George C. Atwell

[57] ABSTRACT

A basketball retrieval and return apparatus is used in combination with a pole-supported basketball backboard to collect shot basketballs that either ricochet off the backboard or fall through a rim attached to the backboard for returning the basketballs to the practicing player or players. The apparatus includes a bracket removably mountable to the lowest portion of the backboard, an elongated support bar pivotally mounted to the bracket, and a U-shaped ring bar attached to the support bar and which extends outwardly from and perpendicular to the backboard when the ring bar is pivoted from a non-use to a use position. In order to maintain the ring bar in its use position, a U-shaped support member is attached to the ring bar and pivots downward toward the level surface or ground so that a pole brace attached to the support member can have one end mounted to a pole bracket which is secured generally to the mid-point of the pole. When the U-shaped ring bar is disposed in its use position, a flexible, collapsibly-extensible netting attached to the ring bar encompasses the rim and net, collects the thrown basketballs, and directs the basketballs to a ball return structure located at the lowest part of the netting whereupon the basketballs can be retrieved by the players.

8 Claims, 5 Drawing Sheets

BASKETBALL RETRIEVAL AND RETURN APPARATUS

BACKGROUND OF THE INVENTION

The present invention relates to basketball retrieval apparatus, and more particularly pertains to a basketball retrieval and return apparatus that is easily and quickly mounted or dismounted to both the basketball backboard and the upright pole supporting the backboard for improving basketball shooting.

As in all sports, the more one practices, the more one's game is improved. The sport of basketball is no exception, and the more practice shooting a player engages in the better his or her shooting will be in game situations. One problem encountered by anyone who has practiced basketball shooting in a playground or gymnasium setting, while shooting basketballs at a basketball rim and backboard mounted above the garage door or at a pole-supported backboard and rim alongside the driveway, is that more time is spent chasing and retrieving the shot basketball than actually shooting the basketball at the rim. Because the practicing player or players will shoot the basketball from various positions about the backboard with varying degrees of force and accuracy, the basketball will ricochet off the backboard at various angles and bounce and roll on the pavement, gym floor or basketball court until physically retrieved by the player or players. This problem is not alleviated by having several players shoot just one basketball because the basketball will ricochet in any direction, and the players simply can't cover the entire area surrounding the backboard.

Therefore, a wide variety of basketball retrieval devices have been conceived to reduce the time spent chasing down shot basketballs. The basketball retrieval devices generally comprise a netting which surrounds the rim and net, and which is mounted to the backboard, or structure supporting the backboard, and some kind of structure disposed beneath the net for collecting the shot basketball and directing it to a collection point or to the practicing player. Two representative basketball retrieval devices in the prior art are U.S. Pat. Nos. 4,786,371 and 4,936,577.

U.S. Pat. No. 4,786,371 includes a pivot structure secured to the rear of the backboard to which is pivotally mounted a frame cross bar. The cross bar includes a pair of spaced-apart, downwardly- and forwardly-extending, elongated support bars between which netting material is attached. A pair of support legs are used to support the netting and the support bars in spaced relationship from the ground or floor surface. Depending on how the shot basketball ricochets off the backboard, it may fall upon and roll down the net toward the practicing player.

U.S. Pat. No. 4,936,577 discloses a framework mounted directly on the front of the backboard, an upper ring member disposed above the hoop and supported by braces and struts, a lower ring member disposed beneath the hoop, and a basketball return which communicates with the lower ring member for returning the basketball to the practicing player.

However, there remains the need for a basketball retrieval device which is easy to mount and dismount from both fan-shaped and square-shaped basketball backboards, does not obstruct the ability of the practicing player or players to move about the backboard and shoot from a variety of positions, and has the capability to return to the player or players a majority of the basketballs that ricochet off the backboard before they strike the ground or floor surface.

SUMMARY OF THE INVENTION

The present invention comprehends a basketball retrieval and return apparatus for mounting to a pole-supported backboard so that shot basketballs can be collected and returned to the practicing player or players, thus facilitating basketball practice shooting and reducing the amount of time necessary to chase down the basketballs that do not go through the rim but instead ricochet off the backboard.

The basketball retrieval and return apparatus includes a bracket which can be removably mounted to the backboard, and preferably is mounted to the rear of the backboard at the lowest central portion thereof so that the bracket is aligned with the rim. The bracket includes a pair of U-shaped hooks which project toward the rim when the bracket is mounted to the backboard and the rim is joined to a flat, right-angled plate attached to the lower front of the backboard and from which the rim projects. An elongated support bar is set on the hooks so that the support bar can be pivoted from a non-use position to a use position when the basketball apparatus is disposed in its operative position for basketball practice shooting.

The support bar includes a pair of integral, oppositely-disposed angled support arms that pivot concomitant with the support bar. When the support bar is pivoted to the use position, the support arms project outwardly past the sides of the backboard in a plane parallel with the plane of the backboard.

The structure that facilitates the collection of the shot basketball or basketballs includes a U-shaped ring bar which is attached to the support bar and is adapted to pivot concomitant with the support bar. More specifically, the ring bar is attached at each of its ends to the respective support arms of the support bar. When the ring bar is disposed in its use position, the ring bar will encompass the net and rim, and will extend outwardly from, and perpendicular to, the backboard. The ring bar will have a width greater than that of the backboard.

Although the ring bar pivots to its use position concomitant with the pivotal movement of the support bar, the ring bar requires other structure to maintain itself in its outward and perpendicular disposition respective to the backboard. A U-shaped support member is pivotally attached to the ring bar, and as the ring bar is pivoted upward to its use position, the U-shaped support member pivots so that it points at an angle toward the pole and ground. Thus, when the ring bar is disposed in its use position, the ring bar is perpendicular to the backboard and spaced above, and parallel to, the ground or floor surface while the support member is positioned beneath the ring bar at an angle to the pole and the ground or level surface.

Because the support member freely pivots respective to the ring bar, a pole brace is attached to the support member; more specifically, the pole brace has a first end which is attached to the support member and a second end which is mounted to a pole bracket. The pole bracket is adapted for removable mounting to the pole at a point generally midway on the pole, and the pole bracket includes structure to receive the pole brace's second end. When the second end of the pole brace is secured to the pole bracket, the angled disposition of the support member is maintained and the outwardly-extending, perpendicular disposition of the ring bar to the backboard is also maintained. The pole brace supports the weight of the ring bar and support member when both are disposed in the use position.

When the basketball apparatus is disposed in its operative position, a flexible, collapsibly-extensible netting attached thereabout the ring bar drops down from the ring bar and forms an upwardly-opening, vertically-elongated, funnel-shaped enclosure which encompasses the rim and net.

In addition, when the netting is disposed beneath the ring bar, basketball return structure can be attached to the lowest portion of the netting to return the basketball to players stationed at various positions about the basketball backboard.

It is an objective of the present invention to provide a basketball retrieval and return apparatus which can be easily and quickly mounted to, and dismounted from, a pole-supported basketball backboard.

It is another objective of the present invention to provide a basketball retrieval and return apparatus which is lightweight, portable and easy to set up or take down.

Yet another objective of the present invention is to provide a basketball retrieval and return apparatus which collects a majority of basketballs shot at the rim and returns the basketballs to the practicing players, but doesn't hinder movement of the players around the rim and backboard by its compact size and elevated disposition above the ground or floor surface.

A better understanding of the present invention will become more apparent from the description, taken in conjunction with the accompanying drawings.

DETAILED DESCRIPTION OF THE PREFERRED EMBODIMENT

Figure 1:
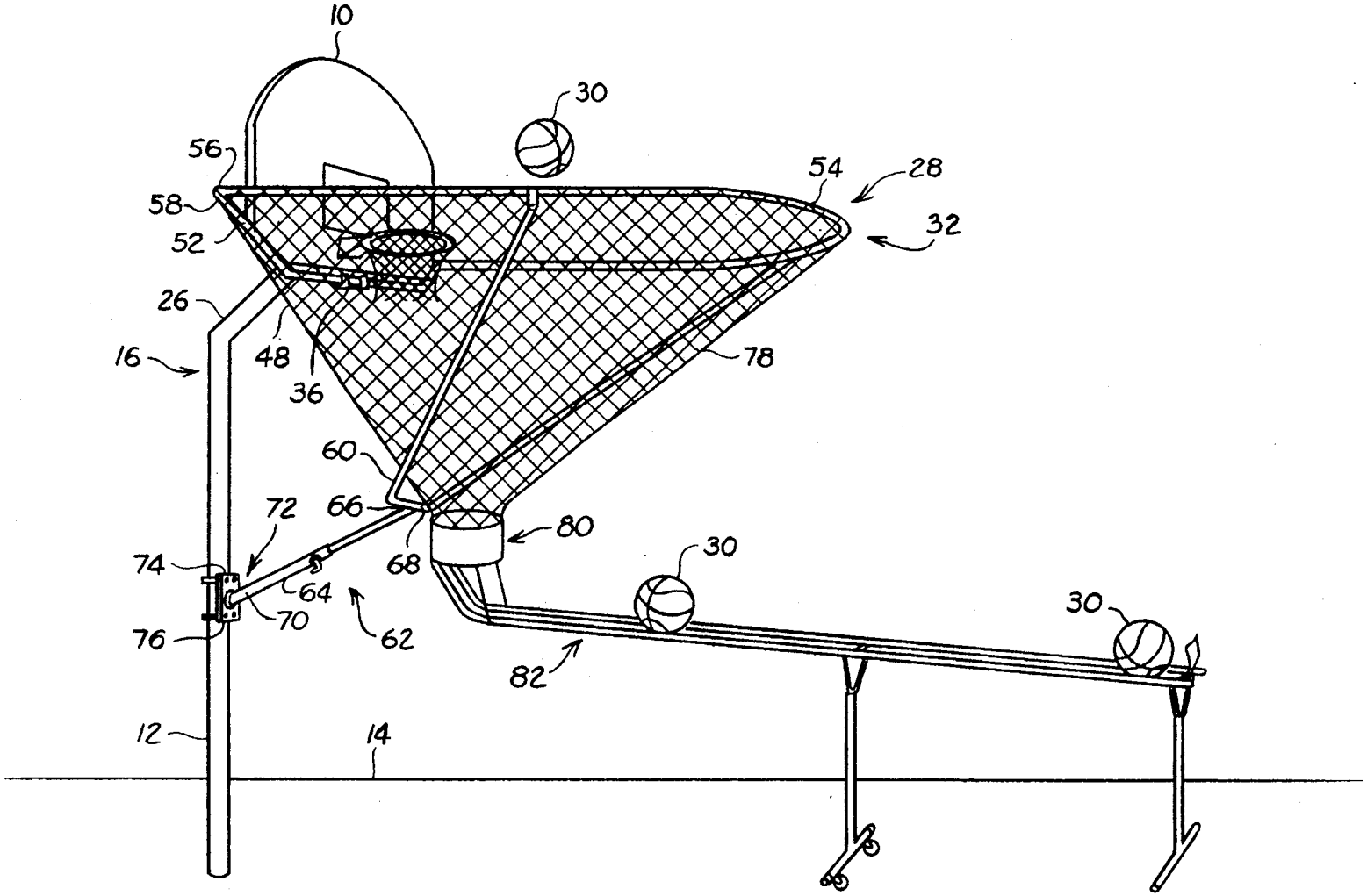
FIG. 1 is a perspective view of the basketball apparatus disposed in the use position and also illustrating basketball return structure attached to the netting.
Figure 3:
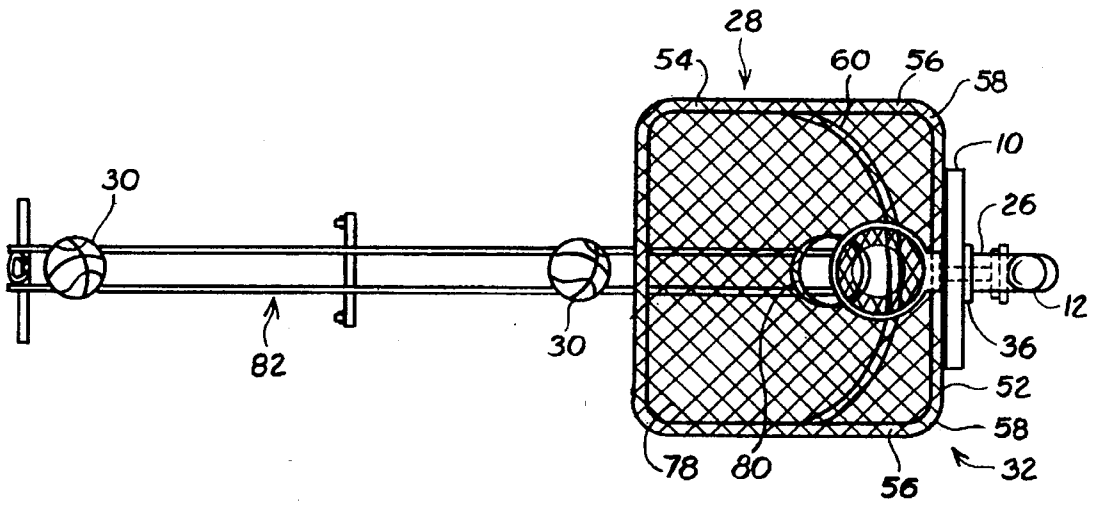
FIG. 3 is a top plan view of the apparatus disposed in the use position.

Referring to FIGS. 1–5, there is shown a standard pole-supported backboard 10 commonly found on school playgrounds, public parks, and alongside driveways or other flat, and usually paved, ground or floor surfaces. This type of basketball apparatus includes an upright pole 12 mounted into the ground 14 and having an upper end 16 to which the wooden or fiberglass backboard 10 is secured. The backboard 10 includes a rim 18 and a net 20 pendent from the rim 18; the rim 18 includes an integral right-angled plate 22 which attaches the rim 18 to the lower central front face 24 of the backboard 10. The backboard 10 is secured to the upper pole end 16 by an extension member 26 which is integrally attached to the upper pole end 16. The extension member 26 can project either perpendicular from the upper pole end 16 or at an angle to the upper pole end 16. Although a basketball backboard can be mounted to any flat vertical surface, such as the inside wall of a gymnasium or the upper portion of a garage wall, the present invention is most applicable to the above-described pole-supported basketball backboard 10.

The present invention is a basketball retrieval and return apparatus, broadly designated by reference number 28, and which is adapted for removable mounting to the pole-supported backboard 10 as shown in FIGS. 1–5.

The apparatus 28 includes a number of elements and features which permit it to collect and continuously return, one after another, basketballs 30 that are shot at the rim 18 by a practicing player or players to thereby enhance and facilitate basketball practice shooting. (Hereinafter the term "player" shall be interpreted to comprise also more than one player.) The apparatus 28 utilizes a generally hoop-shaped frame means 32 which is removably mountable to the lower central rearside 34 of the backboard 10 for collecting and returning shot basketballs 30 to the practicing player.

Figure 6:
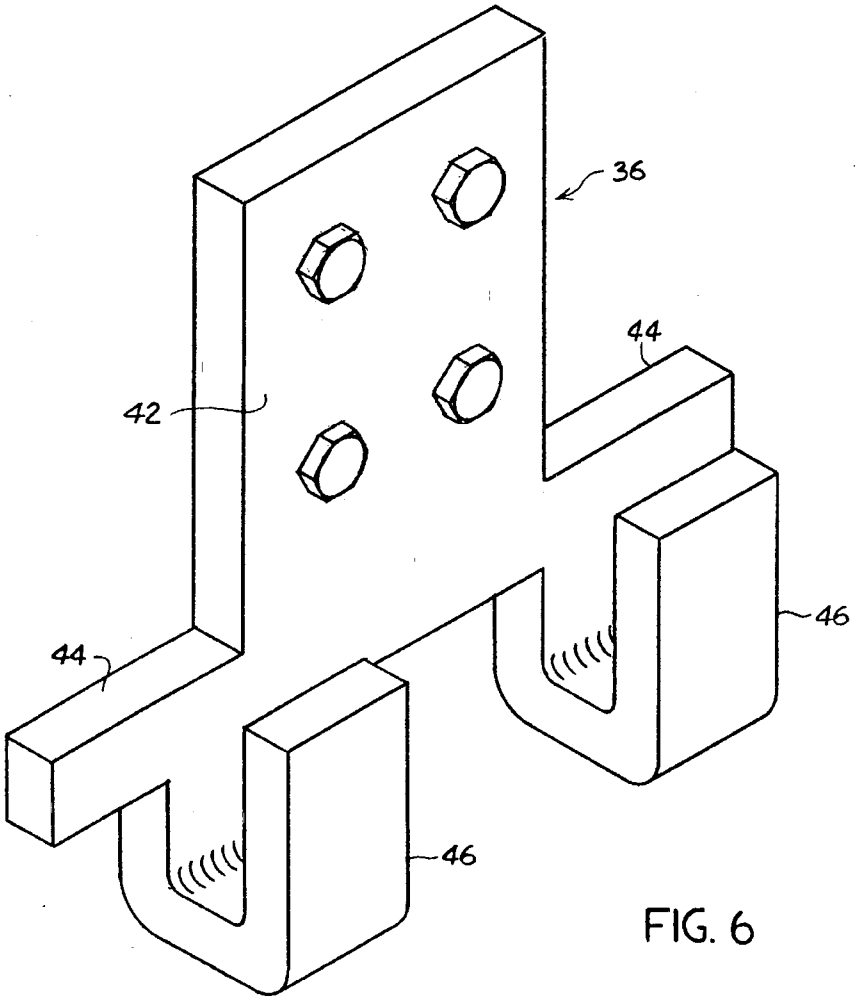
FIG. 6 is an enlarged perspective view of structural elements first shown in FIG. 2 which mount the basketball apparatus to the backboard.
Figure 8:
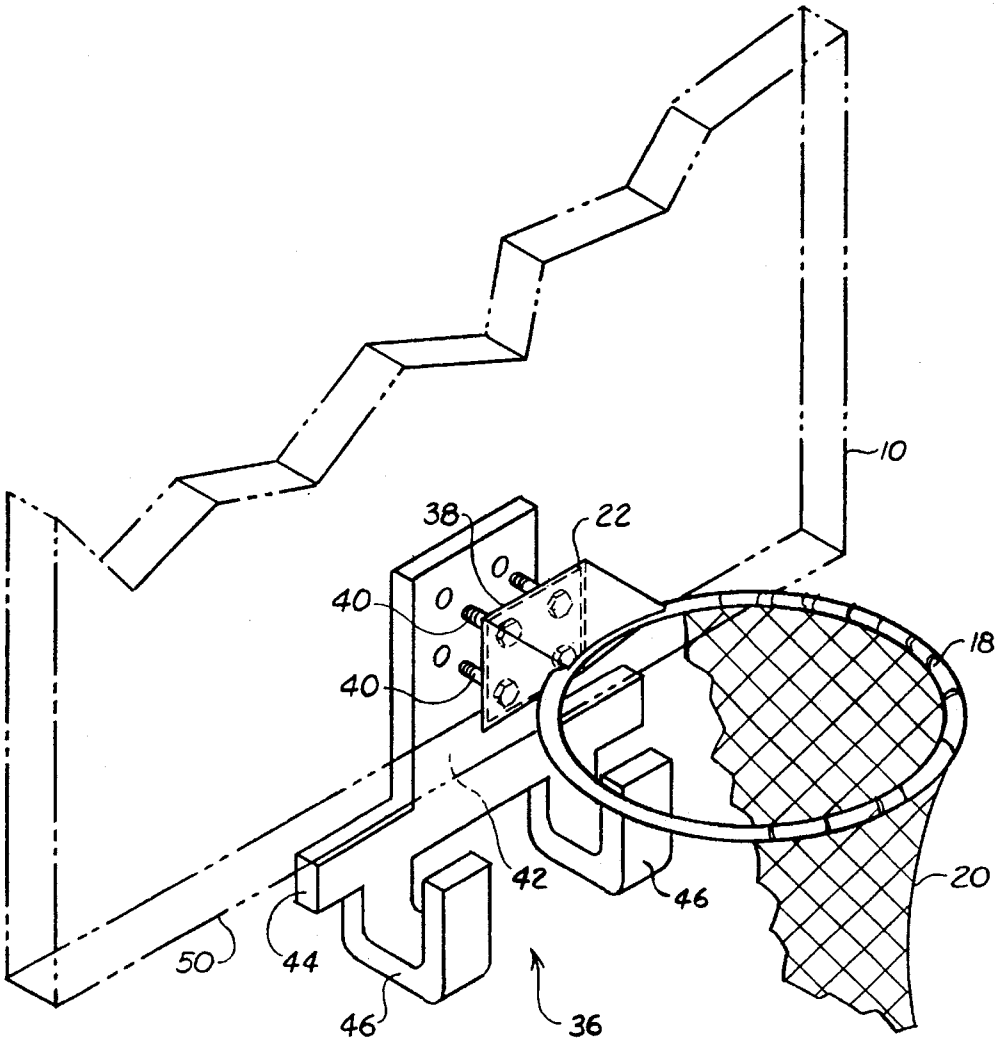
FIG. 8 is an enlarged fragmentary view of structure first shown in FIG. 1 illustrating the manner in which the mounting bracket is attached to the backboard.

Referring to FIGS. 2–6 and 8, there is shown a means to mount the frame means 32 to the backboard 10. Specifically, the means to mount the frame means 32 includes a bracket 36 which is removably mountable to the backboard 10. In order to achieve ease and simplicity of mounting and dismounting, the bracket 36 is secured contiguous to the lower central rearside 34 of the backboard 10. The rim 18 includes a circular portion which defines the rim 18 and is perpendicular to the backboard 10, and the right-angled plate 22 integrally attached to the rim 18. The plate 22 includes a vertical member 38 which is secured contiguous to the lower central front face 24 of the backboard 10. The rim 18 and the bracket 36 are secured together by fasteners, such as bolts 40, that enter from either the front face 24 or the rearside 34 of the backboard 10 and extend through the bracket 36, the backboard 10, and the vertical member 38 of the plate 22. As shown in FIG. 6, the bracket 36 includes a flat member 42 which is integrally attached to an elongated member 44, and the elongated member 44 has two spaced-apart, upwardly-opening, U-shaped receiving members 46 integrally attached to the elongated member 44. When the bracket 36 is attached to the rearside 34 of the backboard 10, the U-shaped members 46 extend slightly past the front face 24 of the backboard 10.

The frame means 32 includes a number of structural elements which permit quick and simple mounting to the bracket 36 for collecting and returning shot basketballs 30 to the practicing player. The frame means 32 is hoop-shaped and manually pivotable from a non-use position to a use position, the use position being the position whereby the frame means 32 can collect and return shot basketballs 30 to the player. The structural elements of the frame means 32 are of lightweight construction (preferably aluminum) so that even grade school children can manually move the frame means 32 from the non-use position to the use position when the frame means 32 is secured to the backboard 10 via the bracket 36.

The frame means 32, as shown in FIGS. 1–6, includes a support bar 48 which is mounted to the backboard 10, and, more specifically, the support bar 48 is set within the U-shaped members 46 of the bracket 36 so that the support bar 48 is capable of pivotal movement while in registration with the U-shaped members 46. Because the U-shaped members 46 project slightly in front of the front face 24 of the backboard 10, when the support bar 48 is disposed to the use position the support bar 48 will be located in a plane slightly spaced from and parallel with the vertical plane of the backboard 10 with respect to the ground or level surface 14. Thus, the support bar 48 will be located slightly beneath a lower edge 50 of the backboard 10 and slightly in front of the front face 24 of the backboard 10.

Referring to FIGS. 1–5, the support bar 48 includes a pair of integral, oppositely-disposed, angled support arms 52 that pivot concomitant with the pivotal movement of the support bar 48. The support arms 52 extend outwardly past the sides of the backboard 10 when the support bar 48 is pivoted to the use position, and the support arms 52 are located in the same vertical plane as the support bar 48. In addition, when the bar 48, and, consequently, the arms 52 are pivoted to the use position, the arms 52 are located in a vertical plane parallel with the vertical plane of the backboard 10 but are spaced slightly therefrom. It will be apparent as the description of the frame means 32 proceeds that the greater the length of the support arms 52 in their extension past the sides of the backboard 10, the greater the number of basketballs 30 that ricochet in various angles off the backboard 10 will be collected by the apparatus 28 and returned to the practicing players.

Figure 2:
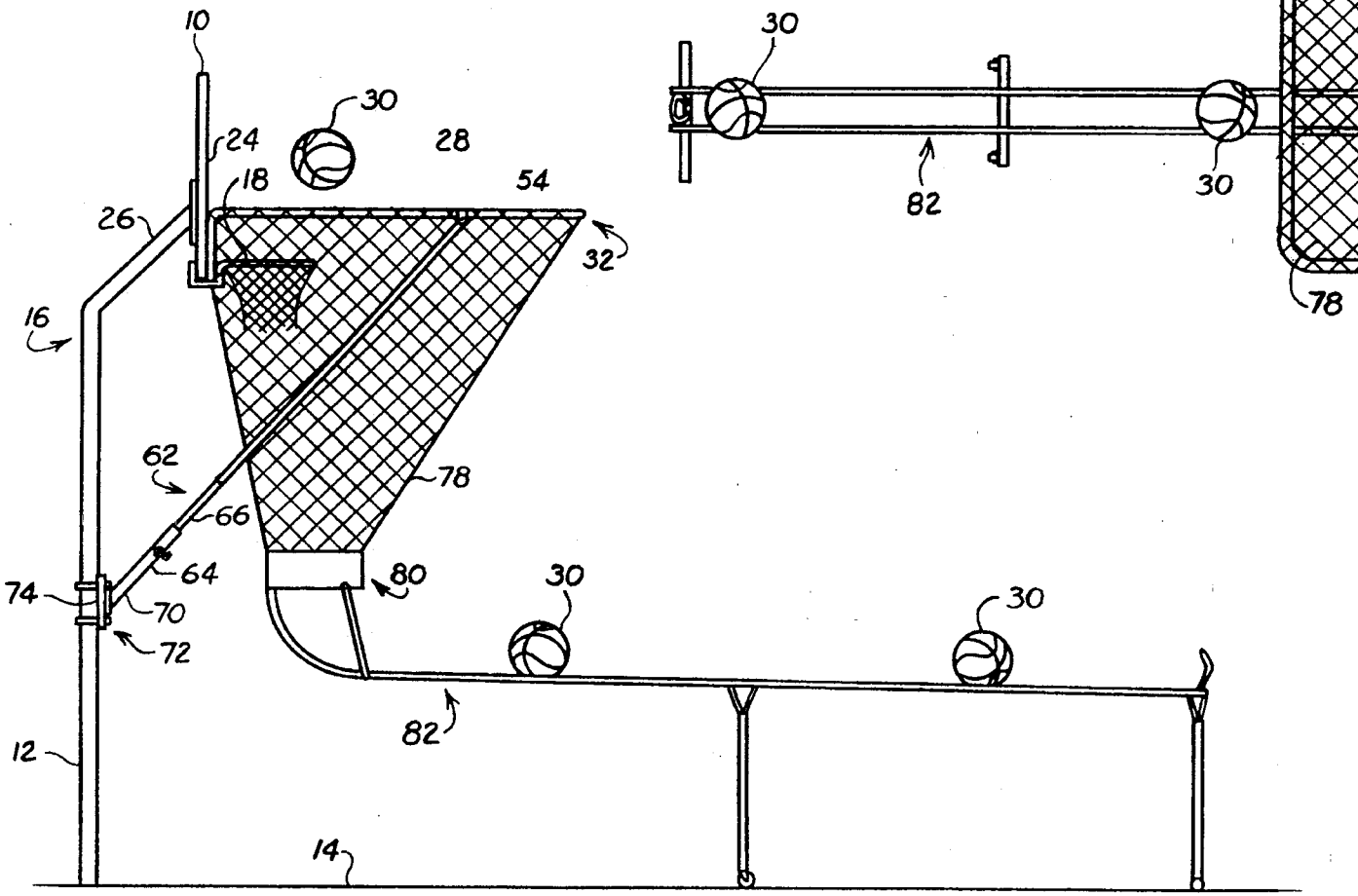
FIG. 2 is a side elevational view of the basketball apparatus illustrating the apparatus disposed in the use position with basketball return structure attached to the netting.
Figure 5:
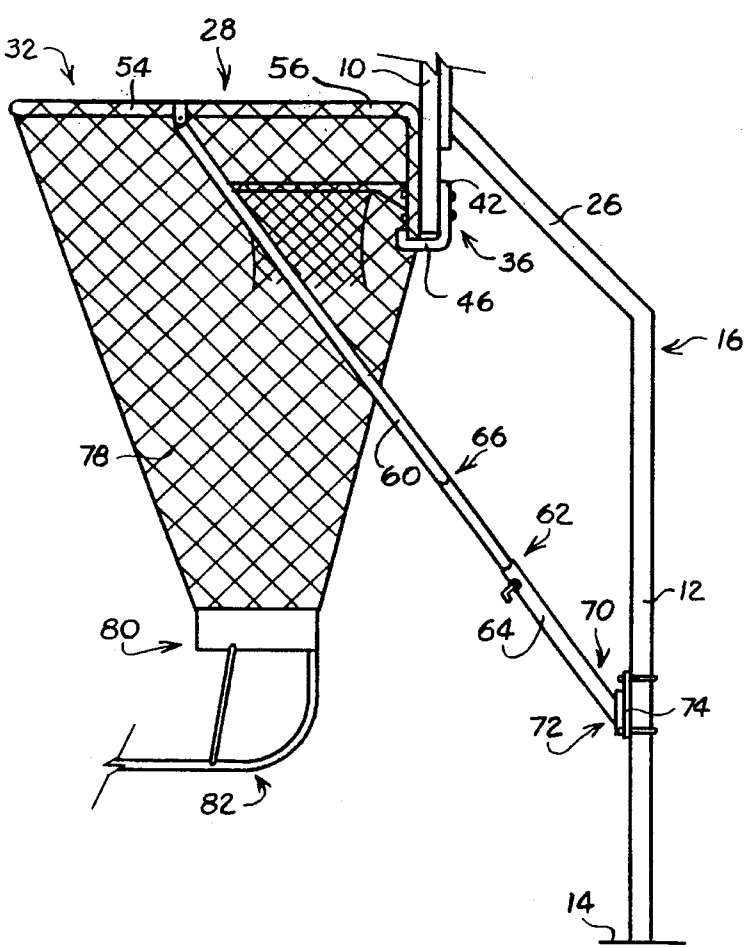
FIG. 5 is a side elevational view of the apparatus first shown in FIG. 2 which illustrates structure to mount the basketball apparatus to the backboard.
Figure 4:
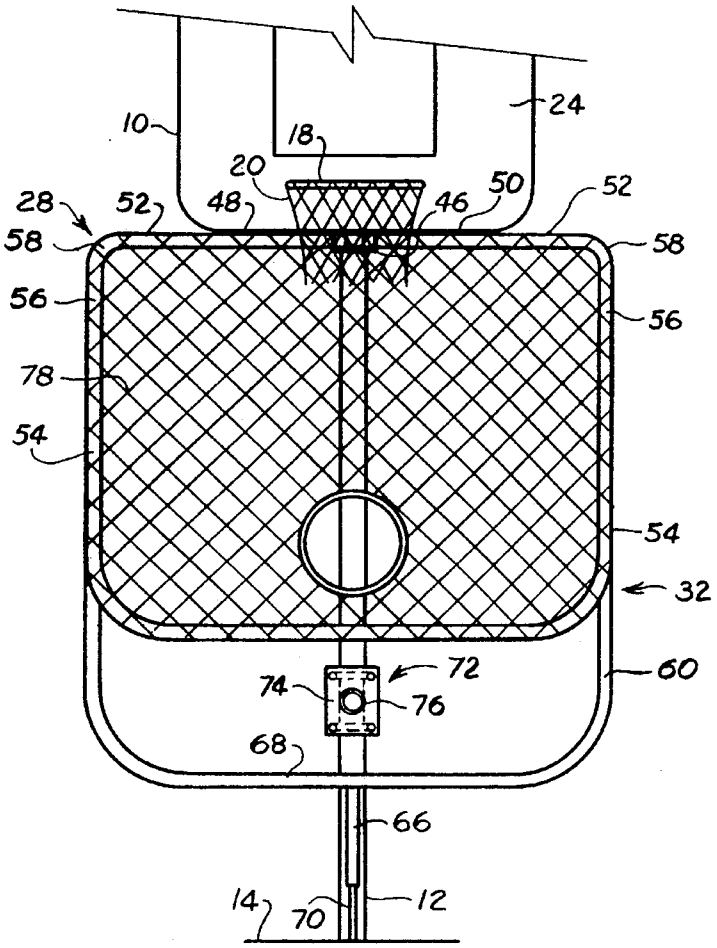
FIG. 4 is a front elevational view of the basketball apparatus disposed in the non-use position.
Figure 7:
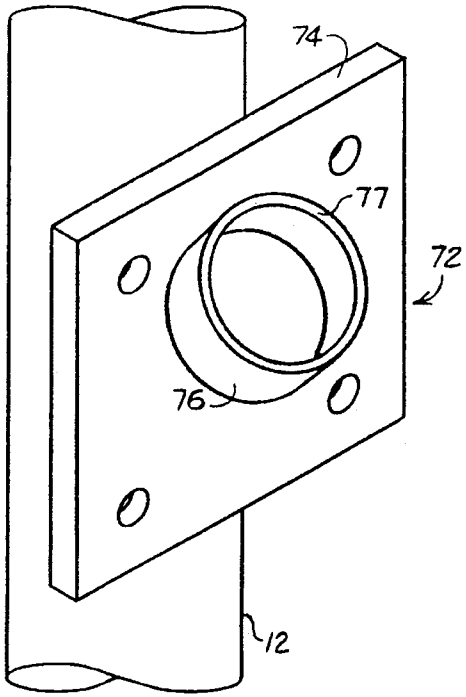
FIG. 7 is an enlarged fragmentary view of structure first shown in FIG. 1 which supports the basketball apparatus when the basketball apparatus is disposed in the use position.

Referring to FIGS. 1–5, the frame means 32 also includes a U-shaped ring bar 54 integrally attached to the support bar 48 and which pivots concomitant with the pivoting movement of the support bar 48. More specifically, the ends 56 of the ring bar 54 are integrally attached to the ends 58 of each respective support arm 52. Thus, the support bar 48, the support arms 52, and the ring bar 54 pivot as one integral unit from the non-use position to the use position or vice versa. When the entire unit is pivoted to the use position, the ring bar 54 will be disposed outwardly from the front face 24 of the backboard 10 and will extend either perpendicular or at a slight angle with respect to the front face 24 of the backboard 10, as shown in FIGS. 1, 2, and 4. The width of the ring bar 54 will obviously be the same as the width of the support arms 52 as measured from the end 58 of one support arm 52 to the end 58 of the other support arm 52. The width of the ring bar 54 will thus be greater than the width of the backboard 10, and the greater the width of the ring bar 54, the greater the number of basketballs 30 that ricochet off the backboard 10 will be collected and returned to the practicing player.

In addition to the ring bar 54, the frame means 32 utilizes a U-shaped support member 60 for supporting and maintaining the ring bar 54 in its use position. As shown in FIGS. 1–5, the support member 60 is pivotally attached to the ring bar 54 and the support member 60 pivots independent of the pivoting movement of the ring bar 54. As shown in FIG. 4, when the apparatus 28 is in the non-use position, the support member 60 hangs from the ring bar 54 in a disposition perpendicular to the ground 14. As the support bar 48 and ring bar 54 are pivoted upward away from the ground 14 to the use position, the support member 60 is pendent to the ring bar 54, and then to fix the ring bar 54 in the use position, the support member 60 is pivoted so that it projects downwardly at an angle toward the midway portion of the pole 12. The support member 60 is then fixed in this angled disposition by structure which will be more fully described hereinafter.

In order to maintain and support the ring bar 54 and the support member 60 in the use position, the apparatus 28 utilizes a brace means. The brace means 62 both supports and maintains the outwardly-projecting, generally perpendicular disposition of the frame means 32 from the central front face 24 of the backboard 10 when the frame means 32 is disposed in the use position. Several elements comprise the brace means 62 as illustrated in FIGS. 1, 2, 4, 5, and 7. The brace means 62 includes a pole brace 64 having a first end 66 which is integrally attached to the support member 60 at the bight portion 68 of the support member 60. The brace 64 is capable of selective extensible and retractable telescoping movement to facilitate securement to the pole 12 at a location generally midway thereon. Because the extension member 26 which projects from the upper pole end 16 and to which the rearside 34 of the backboard 10 is secured is of a variable length, it is necessary that the pole brace 64 be capable of telescoping movement so that a second end 70 of the brace 64 can be brought to a position adjacent the midway portion of the pole 12. In the present invention, the first end 66 of the brace 64 is integrally attached to the bight portion 68 of the support member 60; it is possible that the pole brace 64 could be a separate structural element which would be attached to the bight portion 68 by conventional means such as by being bolted or screwed into a projecting or receiving member (not shown) fixed to the bight portion 68 of the support member 60.

Furthermore, the brace means 62 includes a pole bracket 72, as shown in FIGS. 1, 2, 4, 5, and 7, which is removably securable to the pole 12 at a location generally midway on the pole 12. The pole bracket 72 comprises a flat plate 74 having two pairs of spaced-apart through-holes through which U-bolts are inserted for attaching the bracket 72 to the pole 12. In addition, the pole bracket 72 includes a pole receiving member 76 for receiving the second end 70 of the pole brace 64. The pole receiving member 76 is simply a circular recess impressed or formed on the front face of the flat plate 74 and which is surrounded by a slightly upraised rim or lip 77. The second end 70 of the pole brace 64 is inserted into the pole receiving member 76, and thus the bracket 72 and the pole brace 64 essentially support and maintain the ring bar 54 and the support member 60 in their use position.

Referring to FIGS. 1–8, there is no set manner of attaching the apparatus 28 to the backboard 10. One suggested procedure would be to first locate the bracket 36 on the lower central rearside 34 of the backboard 10. Machine or carriage bolts could be used to secure the bracket 36 to the backboard 10 as well as securing the vertical member 38 of the rim 18 to both the backboard 10 and the bracket 36. With the bracket 36 securely mounted to the rearside 34 of the backboard 10, the support bar 48 would be lifted up and set on the U-shaped receiving members 46 of the bracket 36. Next, the pole bracket 72 would be secured to the pole 12 at a point generally midway on the pole 12, and then the pole bracket 72 would be secured to the pole 12 using the pair of U-bolts inserted through the through-holes of the flat plate 74. Then the ring bar 54 would be pivoted upward away from the ground and to the use position, and, as a result of which the support member 60 would hang perpendicular to the ground 14. The support member 60 would then be moved so that the bight portion 68 of the support member 60 points downward and at an angle to the midway section or portion of the pole 12. The pole brace 64 would then be extended or retracted as necessary so that the second end 70 could be inserted into the pole receiving member 76 of the pole bracket 72, and once this was accomplished the apparatus 28 would be disposed in the use position.

As shown in FIGS. 1–5, a flexible, collapsibly-extensible netting 78 is attached to the support arms 52 and ring bar 54, and as the ring bar 54 is being disposed upward and away from the pole 12 to the use position, the netting 78 is gradually displaced from a non-use position to the use position as shown in FIGS. 1–5. The netting 78 forms an upwardly-opening, vertically-elongated, funnel-shaped enclosure which completely surrounds and encompasses the rim 18 when disposed in the use position. In the present embodiment of the apparatus 28, the ring bar 54 would define a horizontal plane when disposed in the use position that would extend slightly above a horizontally-extending plane defined by the rim 18. While the distance of the ring bar 54 above the rim 18 can vary as a result of the angle of the support arms 52, the apparatus 28 will collect more basketballs 30 when the ring bar 54 is located above the rim 18 as opposed to the ring bar 54 being located beneath the horizontal plane of the rim 18. Moreover, the lowest portion of the netting 78 includes a ring member 80 which can be attached to basketball return structure, broadly designated by reference number 82, and which is disclosed in U.S. Pat. No. 5,016,875 (column 7, lines 14–54).

While there is shown and described a preferred embodiment of the basketball retrieval and return apparatus, it is to be understood that the apparatus is susceptible to change and modification within the practicability of the invention and, therefore, the invention comprehends all such variations thereof as come within the scope of the appended claims.

I claim:

1. A basketball retrieval and return apparatus for collecting and returning shot basketballs and which is selectively movable from a non-use to a use position, the apparatus used in combination with a pole-supported backboard having a rim attached thereto, the apparatus comprising:

a support bar mounted to the backboard and which is capable of pivoting from a non-use to a use position;

the support bar spaced from the backboard and located in a plane parallel with the vertical plane of the backboard when the support bar is disposed in the use position;

a pair of oppositely-disposed, angled support arms attached to the support bar and pivoting concomitant with the support bar so that the support arms extend outwardly past the backboard in a plane parallel with the plane of the backboard when the support bar is disposed from the non-use to the use position;

a U-shaped ring bar attached to the support arms and which pivots concomitant with the pivoting movement of the support bar so that the ring bar is disposed outwardly from the backboard when the support bar is pivoted to the use position, and the ring bar has a width greater than the width of the backboard;

a brace means for maintaining and supporting the outwardly-projecting disposition of the ring bar from the backboard when the ring bar is disposed in the use position; and a flexible, collapsibly-extensible netting attached to the support arms and ring bar and capable of forming an upwardly-opening, vertically-elongated, funnel-shaped enclosure surrounding the rim when the apparatus is disposed in the use position.

2. The apparatus of claim 1 further comprising a U-shaped support member pivotally attached to the ring bar and which pivots downward toward the pole for supporting the ring bar in its outwardly-projecting disposition from the backboard.

3. The apparatus of claim 2 further comprising a means to mount the support bar to the backboard.

4. The apparatus of claim 3 wherein the means to mount the support bar to the backboard includes a bracket centrally mounted to the backboard and in alignment with the rim.

5. The apparatus of claim 4 wherein the brace means includes a pole brace having a first end attached to the U-shaped support member and a second end secured at a location generally midway on the pole.

6. The apparatus of claim 5 wherein the pole brace is capable of extensible and retractable telescoping movement to facilitate securement of the second end of the pole brace at a location generally midway on the pole.

7. The apparatus of claim 6 further comprising a pole bracket adapted for removable securement to the pole and which receives the second end of the pole brace.

8. The apparatus of claim 20 7 wherein the pole bracket includes a pole receiving member into which the second end of the pole brace is inserted to support the support member and the ring bar when both the support member and ring bar are disposed in the use position.

* * * * *